US005907663A

United States Patent [19]

Lee

[11] Patent Number: 5,907,663

[45] Date of Patent: May 25, 1999

[54] FAR-INFRARED ELECTRIC HEATER

[76] Inventor: Wen-Ching Lee, No. 214, 3rd, Floor, Fu-Hsing North Road, Taipei, Taiwan

[21] Appl. No.: 09/104,061

[22] Filed: Jun. 24, 1998

[51] Int. Cl.[6] ..... A45D 20/40; H05B 3/10

[52] U.S. Cl. ..... 392/407; 392/407; 392/408; 392/488; 219/553; 219/546; 219/534; 219/544

[58] Field of Search ..... 392/407, 408, 392/488; 219/553, 546, 534, 544; 338/301, 302, 234, 236, 270; 313/110, 113

[56] References Cited

U.S. PATENT DOCUMENTS

| | | | |
|---|---|---|---|
| 3,716,693 | 2/1973 | Bleckmann | 219/553 |
| 4,412,126 | 10/1983 | Brockway | 219/553 |
| 4,621,182 | 11/1986 | Driggers | 219/85.13 |
| 4,774,396 | 9/1988 | Salit et al. | 219/553 |
| 5,077,461 | 12/1991 | Hasegawa | 219/553 |
| 5,212,763 | 5/1993 | Arnold et al. | 392/488 |

*Primary Examiner*—Teresa Walberg
*Assistant Examiner*—Vinod Patel
*Attorney, Agent, or Firm*—Pro-Techtor International Services

[57] ABSTRACT

Disclosed is a far-infrared electric heater mainly including an electric heating coil, an inner element set in the heating coil, and an outer tubular member enclosing and insulating the heating coil and the inner element. The inner element is made by mixing and sintering quartz and far-infrared optical material. Continuous teeth are provided on outer surface of the inner element and/or inner surface of the outer tubular member to increase surface area for enhancing the reflection of the radiant far-infrared rays, so that an object can be heated by the electric heater in a highly efficient manner.

3 Claims, 3 Drawing Sheets

A-A'

B-B′

FAR-INFRARED ELECTRIC HEATER

BACKGROUND OF THE INVENTION

The present invention relates to an improved far-infrared electric heater, and more particularly to a far-infrared electric heater including an electric heating coil wound about an inner element formed from sintered quartz and far-infrared optical material and then covered with an outer tube. An inner surface of the outer tube and/or an outer surface of the inner element can be provided with continuous teeth to achieve optimal heating effect.

It has been known that far-infrared heaters are widely employed in general domestic appliances, such as electric ovens, radiant heaters, microwave ovens, etc. The employment of far-infrared heaters can generally have the advantages of fast and even heating, lower consumption of energy, and superior heating effect. FIGS. 1 and 2 illustrate a conventional far-infrared heater that has been currently widely used in an electric oven. As shown, the far-infrared heater includes an electric heating coil 1 set in an outer tube 2 which serves as a supporter and insulator for the heating coil 1. Generally, the outer tube 2 is made of high-temperature resistant and insulating materials, such as quartz, ceramic enamel, or other ceramic materials. Moreover, far-infrared optical paint 3 is sprayed over circumferential surface of the outer tube 2. The electric heating coil 1 spirally extends with two ends thereof connected to a power source. When the heating coil 1 is supplied with a current and heated, it produces radiant energy which passes the far-infrared optical paint 3 over the circumferential surface of the outer tube 2 and is refracted to produce far-infrared sources. The produced far-infrared rays are further reflected by an aluminum-plated inner case of the electric oven in which the far-infrared heater is installed, so that food in the electric oven is subjected to the far-infrared rays from different directions in the oven and can be evenly heated and cooked within a shortened time.

Generally, there are three ways to combine the far-infrared optical paint 3 with the outer tube 2: 1) the far-infrared optical paint is sprayed over the circumferential surface of a quartz tube, 2) the far-infrared optical paint is sprayed over the circumferential surface of a ceramic enamel tube, and 3) the far-infrared optical paint is mixed with ceramic powder and the mixture is sintered to form the outer tube 2. However, following problems with the outer tube 2 formed from these three ways can be found from long-term observation over the use of such outer tube 2 in the conventional far-infrared heater:

A. For a quartz tube sprayed with far-infrared optical paint:

a. The sprayed far-infrared optical paint tends to be scraped off during transportation or assembling and makes the quartz tube looking ugly;

b. The sprayed far-infrared optical paint tends to peel off when the quartz tube is heated at high temperature and therefore contaminates food being cooked;

c. The far-infrared optical paint is not well pervious to light that results in slow raising of temperature and prolonged time of baking or roasting, as well as low working efficiency and higher consumption of energy;

d. The far-infrared optical paint forms uneven surface on the outer tube. Grease from the cooked food tends to attach to and cumulate on the uneven surface and is not easily removed therefrom after the far-infrared heater has been used for a long time. The grease-attached far-infrared heater looks ugly and dirty, and will adversely affect the radiation of the far-infrared rays; and e. When the outer tube 2 is broken, the spirally extended heating coil 1 is not supported and is easily exposed to the open air to dangerously shock a user.

B. For a ceramic enamel tube sprayed with far-infrared optical paint:

a. The sprayed far-infrared optical paint tends to be scraped off during transportation or assembling and makes the ceramic enamel tube looking ugly;

b. The sprayed far-infrared optical paint tends to peel off when the ceramic enamel tube is heated at high temperature and therefore contaminates food being cooked;

c. The ceramic enamel tube sprayed with the far-infrared optical paint is even inferior in its perviousness to light than the quartz tube and therefore has even slower raising of temperature and needs longer time of baking or roasting. The efficiency of energy conversion is even lower and the consumption of energy is even higher than the quartz tube;

d. The far-infrared optical paint forms uneven surface. Grease from the cooked food tends to attach to and cumulate on the uneven surface and is not easily removed therefrom after the far-infrared heater has been used for a long time. The grease-attached far-infrared heater looks ugly and dirty, and will adversely affect the radiation of the far-infrared rays; and e. When the outer tube 2 is broken, the spirally extended heating coil 1 is not supported and is easily exposed to the open air to dangerously shock a user.

C. For a ceramic outer tube containing far-infrared optical material through sintering:

a. Like the ceramic enamel tube, this type of ceramic tube is even inferior in its perviousness to light than the quartz tube and therefore has even slower raising of temperature and needs longer time of baking or roasting. The efficiency of energy conversion is even lower and the consumption of energy is even higher than the other two types of outer tubes;

b. The far-infrared optical paint forms uneven surface. Grease from the cooked food tends to attach to and cumulate on the uneven surface and is not easily removed therefrom after the far-infrared heater has been used for a long time. The grease-attached far-infrared heater looks ugly and dirty, and will adversely affect the radiation of the far-infrared rays; and c. When the outer tube 2 is broken, the spirally extended heating coil 1 is not supported and is easily exposed to the open air to dangerously shock a user.

SUMMARY OF THE INVENTION

It is therefore a primary object of the present invention to provide a far-infrared electric heater which eliminates the drawbacks existing in the conventional far-infrared electric heaters to best extend the function of far-infrared rays.

To achieve the above and other objects, the far-infrared electric heater according to the present invention mainly includes a spirally wound electric heating coil set in an outer tubular member, and an inner element formed by sintering a mixture of quartz and far-infrared optical material. The inner element is set in the spiral electric heating coil and can be optionally provided at an outer surface with continuous teeth. The outer tubular member can also be provided at an inner surface with continuous teeth. These teeth provide increased surface areas of the inner element and the outer tubular member to enhance reflection of the far-infrared rays produced by the heated electric heating coil, inner element, and the outer tubular member, so that the far-infrared electric heater of the present invention has largely improved working efficiency.

BRIEF DESCRIPTION OF THE DRAWINGS

A more complete understanding of these and other features and advantages of the present invention will become apparent from a careful consideration of the following detailed description of certain embodiments illustrated in the accompanying drawings, wherein.

DETAILED DESCRIPTION OF THE PREFERRED EMBODIMENTS

Figure 1:
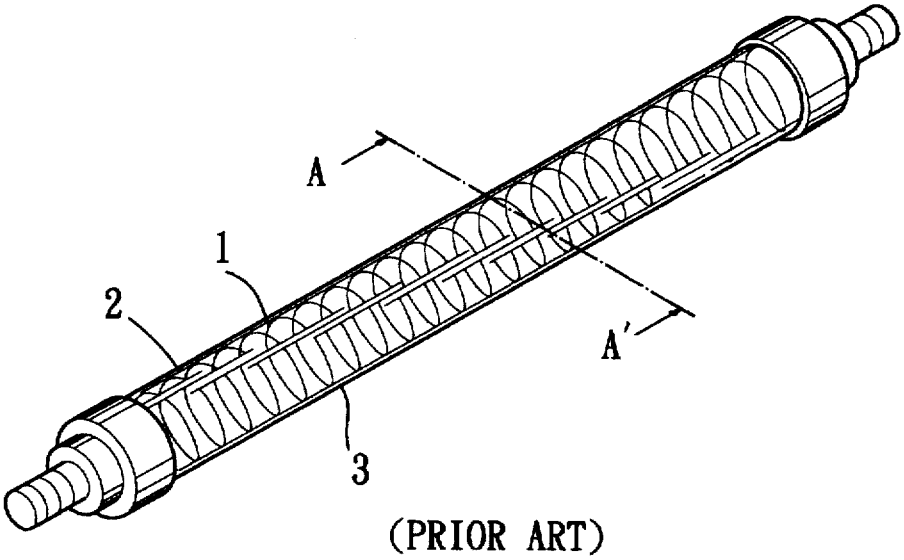
(PRIOR ART) FIG. 1
FIG. 1 is a perspective of a conventional far-infrared electric heater.
Figure 2:
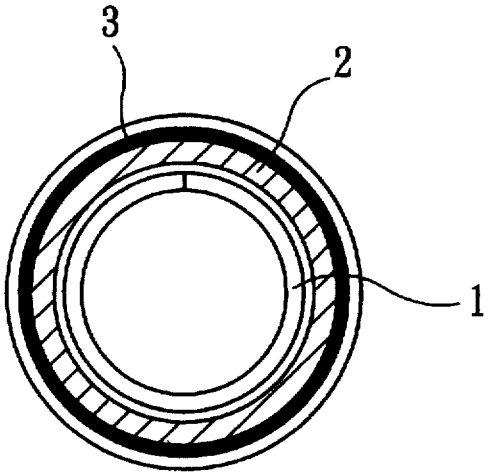
(PRIOR ART) FIG. 2
FIG. 2 is a cross section taken on line A–A' of FIG. 1.
Figure 3:
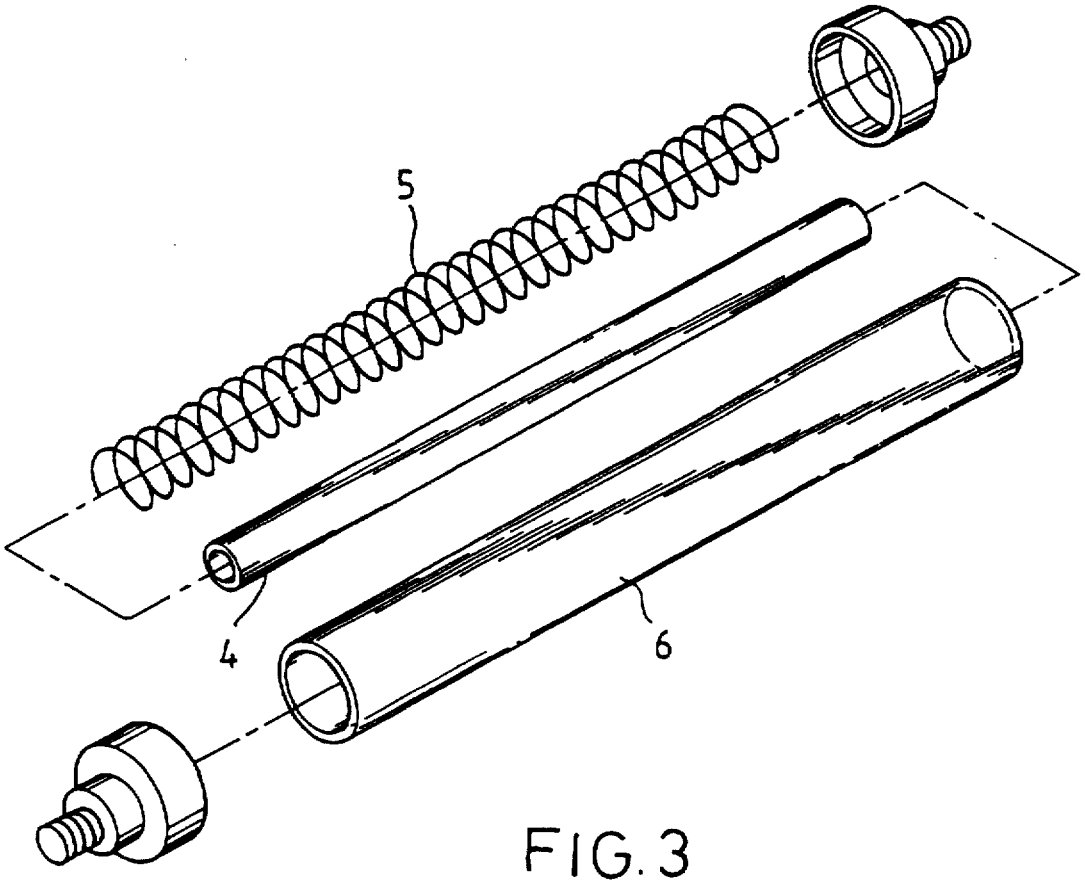
FIG. 3 is an exploded perspective of a far-infrared electric heater according to the present invention.
Figure 4:
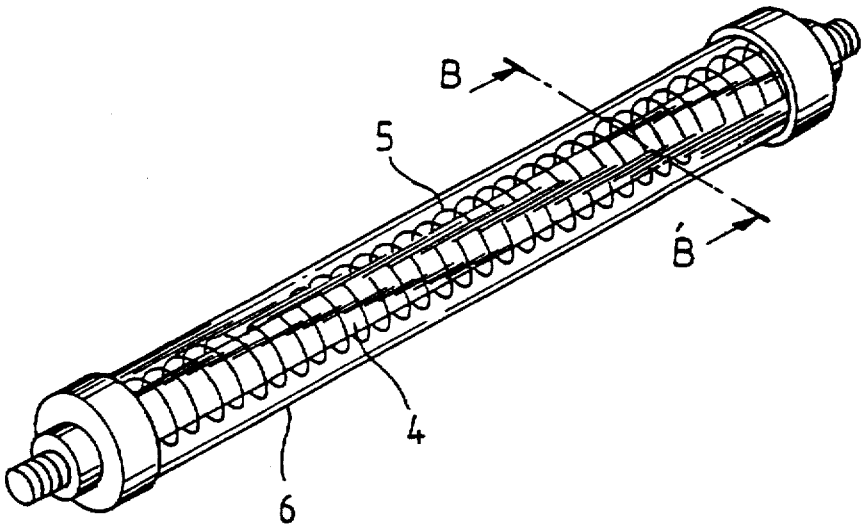
FIG. 4 is an assembled perspective of the far-infrared electric heater of FIG. 3.

Please refer to FIGS. 3 and 4 that are exploded and assembled perspectives, respectively, of a far-infrared electric heater of the present invention. As shown, the heater mainly includes an inner element 4, a spirally extended electric heating coil 5, and an outer tubular member 6.

The inner element 4 can be formed from, for example, a tubular member coated with far-infrared optical material or containing far-infrared optical material through sintering and is set in the heating coil 5 so that the coil 5 spirally winds about and extends along the inner element 4. The outer tubular member 6 is formed from any tube made of high-temperature resistant and insulating material, such as quartz tube, ceramic tube, or ceramic enamel tube. The heating coil 5 with the inner element 4 set therein is then set in the outer tubular member 6, so that the outer tubular member 6 serves as a insulator for the heating coil 5. The outer tubular member 6 also serves as a support means for the heating coil 5 in the event the individual coils of the heating coil 5 soften and droop when they are heated.

Figure 5:
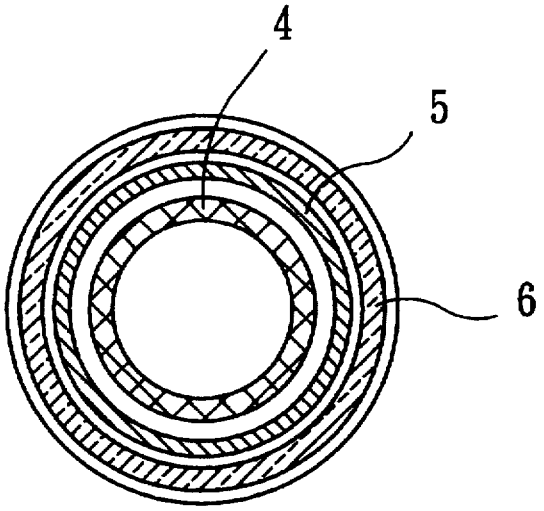
FIG. 5 is a cross section taken on line B–B' of FIG. 4.

FIG. 5 shows a cross section taken on line A–A' of FIG. 4. When the electric heater is supplied with a current, the heating coil 5 is heated to radiate far-infrared rays, and an electromagnetic reaction is produced on the far-infrared material contained in the inner element 4. The radiated far-infrared rays are reflected to pass through the outer tubular member 6 and are refracted to an object to be heated. In the course of heating the coil 5 and the inner element 4, other visible lights, near-infrared rays, and middle-infrared rays produced at the same time all are not blocked and can be simultaneously radiated on the object to be heated. That is, the electric heater according to the present invention may have upgraded working efficiency.

Figure 6:
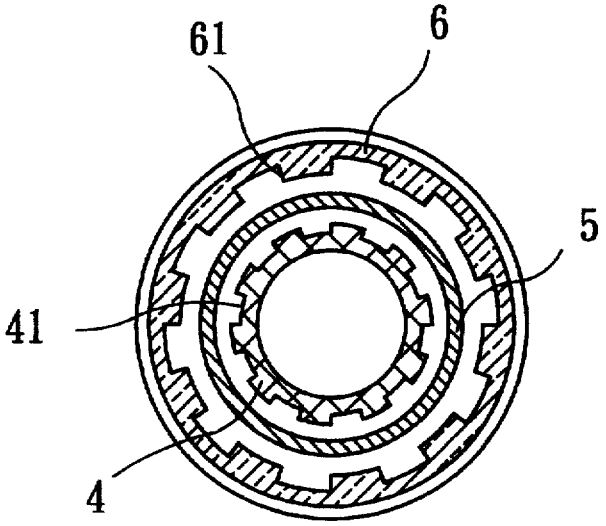
FIG. 6 is a cross section similar to FIG. 5 but shows another embodiment of the present invention.

FIG. 6 shows another cross sectional view of a far-infrared electric heater according to another embodiment of the present invention. As shown, the inner element 4 and the outer tubular member 6 are provided at outer wall and inner wall, respectively, with a plurality of continuous teeth, so that a toothed outer surface 41 and a toothed inner surface 61 are formed on the inner element and the outer tubular member 4 and 6, respectively. The toothed outer surface 41 and the toothed inner surface 61 provide largely increased surface areas with high refraction ratio and accordingly enable the electric heater of the present invention to have even more excellent function of providing far-infrared rays.

The inner element 4 coated with far-infrared optical material or containing far-infrared optical material through sintering is not necessarily a tubular member. The inner element 4 can be a solid bar or of any other shape that is suitable for set in the spirally extended coil 5.

In accordance with one aspect of the present invention, the outer tubular member 6 is formed from a tube containing far-infrared optical material and quartz through sintering to posses the function of producing far-infrared rays. Advantages of such outer tubular member 6 include low manufacturing cost, high energy conversion efficiency, easy to clean, etc. No grease will cumulate on outer surface of the outer tubular member 6 made of sintered quartz-infrared material to adversely affect the radiation of far-infrared rays from the heater of the present invention.

In accordance with another aspect of the present invention, the outer tubular member 6 is made of quartz tube and is provided with continuous toothed inner surface 61, creating an inner wall area that is much larger than that of a conventional tube with smooth and round inner surface. Such toothed inner wall surface provides increased reflective surface area and allows enhanced far-infrared radiation.

In accordance with another aspect of the present invention, the outer tubular member 6 is made by sintering quartz and far-infrared optical material and is provided with continuous toothed inner surface 61. Such outer tubular member 6 not only radiates far-infrared rays, but also provides increased reflective surface area that enables faster raising of temperature.

In accordance with another aspect of the present invention, the inner element 4 is in the form of a tubular member made of high-temperature resistant and highly reflective material and serves as a supporter of the heating coil 5 in the event the individual coils of the heating coil 5 soften and droop when they are heated.

In accordance with another aspect of the present invention, the inner element 4 is in the form of a solid bar made of high-temperature resistant and highly reflective material and serves as a supporter of the heating coil 5 in the event the individual coils of the heating coil 5 soften and droop when they are heated.

In accordance with another aspect of the present invention, the inner element 4, either in the form of a tubular member or a solid bar, is coated with far-infrared optical paint to enhance the reflection of the produced far-infrared rays.

In accordance with another aspect of the present invention, the inner element 4, either in the form of a tubular member or a solid bar, is made of high-temperature resistant material and far-infrared optical material through sintering at high temperature, so that the inner element 4 is excellent in reflecting far-infrared rays.

In accordance with another aspect of the present invention, the inner element 4 is provided with toothed outer surface to increase total reflective surface areas and provide enhanced reflection of far-infrared rays.

The above-described outer tubular members and inner elements can be freely combined to work with the heating coil.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A far-infrared electric heater comprising an inner element, an electric heating coil, and an outer tubular member for supporting and insulating said electric heating coil; said inner element being formed by mixing and sintering quartz and far-infrared optical material, said inner element being contained within said electric heating coil; said electric heating coil radiating far-infrared rays when it is supplied with a current and heated; and an outer circumferential surface of said inner element and an inner circumferential surface of said outer tubular member being provided with a plurality of continuous teeth, whereby said far-infrared electric heater has increased surface area to reflect far-infrared rays radiated by said electric heating coil to an object to be heated and thereby provides enhanced working efficiency.

2. The far-infrared electric heater as claimed in claim 1, wherein said inner element is a tubular member.

3. The far-infrared electric heater as claimed in claim 1, wherein said inner element is a bar-like member.

* * * * *